United States Patent [19]

Mishio

[11] Patent Number: 4,576,491

[45] Date of Patent: Mar. 18, 1986

[54] PRINTING HEAD

[75] Inventor: Hiroshi Mishio, Morioka, Japan

[73] Assignee: Alps Electric Co., Ltd., Japan

[21] Appl. No.: 622,848

[22] Filed: Jun. 21, 1984

[30] Foreign Application Priority Data

Jun. 21, 1983 [JP] Japan ..... 58-95481[U]
Oct. 20, 1983 [JP] Japan ..... 58-162298[U]

[51] Int. Cl.[4] ..... B41J 3/12
[52] U.S. Cl. ..... 400/124; 101/93.05
[58] Field of Search ..... 400/124; 101/93.05

[56] References Cited

U.S. PATENT DOCUMENTS 3,848,719 11/1974 Milan ..... 400/124

*Primary Examiner*—Paul T. Sewell
*Attorney, Agent, or Firm*—Guy W. Shoup

[57] ABSTRACT

A printing head for printing dot-shaped records on a recording medium includes a plurality of electromagnets, armatures operated by the electromagnets to depress a plurality of depressing members so that the depressing members are moved linearly, and a resilient member urging the depressing members toward the armatures. The printing head further includes a plurality of imprinting wires extended linearly and secured to the depressing members, so that the imprinting wires are moved linearly according to the operation of the electromagnets.

5 Claims, 3 Drawing Figures

PRINTING HEAD

BACKGROUND OF THE INVENTION

This invention relates to a small size printing head which uses wire elements to print by a plurality of dots.

Wire dot printing heads are widely used in recent printers. FIG. 1 illustrates a conventional wire dot printing head with the lower half in section. The wire dot printing head comprises a casing 1 having a circular section. A plurality of electromagnets 2 and armatures 3 operated by the electromagnets 2 are arranged around the central axis of the casing 1. The armatures 3 are connected at their outer end portions for pivotal movement relative the respective electromagnet 2. In a cylindrical portion 1*a* intergal with the casing 1, a pair of guide plates 5*a* and 5*b* made of a plastic material are provided for slidably guiding wires 4 to be used for wire dot printing. At an end of the cylindrical portion 1*a* is provided a highly wear-resistant guide plate 6 that supports the outer ends of the wires 4. The other ends of the wires 4 are formed into contacting portions 7 connected with the armatures 3. A coil spring 8 is provided around the contacting portion 7 so as to urge the same in a direction to separate the armature 3 from the electromagnet 2.

Upon energization of one or more of the electromagnets 2, the armature 3 corresponding to the energized magnet 2 is attracted by the magnet 2 against the force of the coil spring 8 to cause the outer ends of the wires 4 coupled with the armatures 3 to project outwardly from the end of the cylindrical portion 1*a* of the casing 1 so as to impact on a recording paper through an inked ribbon. By combining the movement of a carriage that supports the printing head with the projecting movements of the wires 4, a required dot printing operation can be carried out on the recording paper.

In the above described conventional printing head, however, the armatures 3 and the coil springs 8 are directly coupled with the inner ends of the wires 4, while the outer ends of the wires 4 are guided by the guide plate 6 in a minutely spaced apart relation. Thus the wires 4 inevitably follow a curved path from the positions surrounded by the coil springs 8 to the positions supported by the guide plates 5*a* and 5*b*. As a consequence, frictional forces are created between the guide plates 6, 5*a* and 5*b* and the wires 4 when the wires are returned to their original positions by the resilient forces of the springs 8, thus increasing the sliding resistances of the wires 4. The frictional forces created between the wires 4 and the guide plates 6, 5*a* and 5*b* not only adversely affect the operational life of the printing head, but also necessitate coil springs 8 of large spring forces and electromagnets 2 of large capacities be provided, thus increasing the power consumption.

Furthermore, each of the wires 4 has a diameter ranging from 0.2 to 0.35 mm, and must be passed through the guide plates 5*a* and 5*b* and the guide plate 6 so as to be extended along a bent passage, and each of the coil springs 8 must be placed around the stem portion of the wire 4, and therefore the assembling work of the conventional printing head is extremely troublesome. Since the required lengths of the wires 4 are different by the positions of the wire ends, it has been an ordinary practice that the outer ends of the wires 4 are cut away after the insertion of the wires 4 through the aforementioned passages so that the wire ends are arranged in a plane. This requires a difficult production step requiring a high precision and a long operation time. As a consequence, there is a limitation in reducing the cost of the printing head, which constitutes a difficulty in reducing the cost of small size printers for personal computers and the like which are required to be of low cost.

In addition, since the wires 4 in the conventional printing head are extended along bent passages, the cylindrical portion 1*a* of the casing 1 is required for straightening the movement of the end portions of the wires. The portion 1*a* increases the space of the entire printing head and deteriorates the space factor of the printing head.

SUMMARY OF THE INVENTION

An object of the present invention is to provide a printing head of the wire-dot type wherein frictional forces between wires and wire guides are reduced, and therefore the wires can be operated smoothly.

Another object of the invention is to provide a printing head of a wire-dot type wherein wires extending linearly are utilized for facilitating the assembling and for reducing the production costs of the printing head.

Still another object of the invention is to provide a printing head of a wire-dot type wherein the depressing forces of armatures and the returning forces of a resilient member are exerted effectively with minimal movement of the wires, so that a smooth printing operation of the printing head is assured.

Yet another object of the invention is to provide a wiredot type printing head wherein the projecting ends of the wires are spaced apart by a minute distance even though the armatures may have a greater space therebetween.

A further object of the invention is to provide a wire-dot type printing head wherein the printing wires can be operated linearly in a casing, and the depressing forces of the armatures operate the wires without large losses of energy.

According to the present invention, there is provided a printing head comprising a plurality of electromagnets and armatures attracted by the electromagnets. A plurality of depressing members are linearly slidable in response to the movements of the armatures, and a resilient member urges the depressing members toward the armatures. A plurality of imprinting wires extend linearly and have their one ends projecting out of the printing head while the other ends are secured to the depressing members, so that the imprinting wires are linearly movable according to the operation of the electromagnets.

DESCRIPTION OF THE PREFERRED EMBODIMENT

Figure 1:
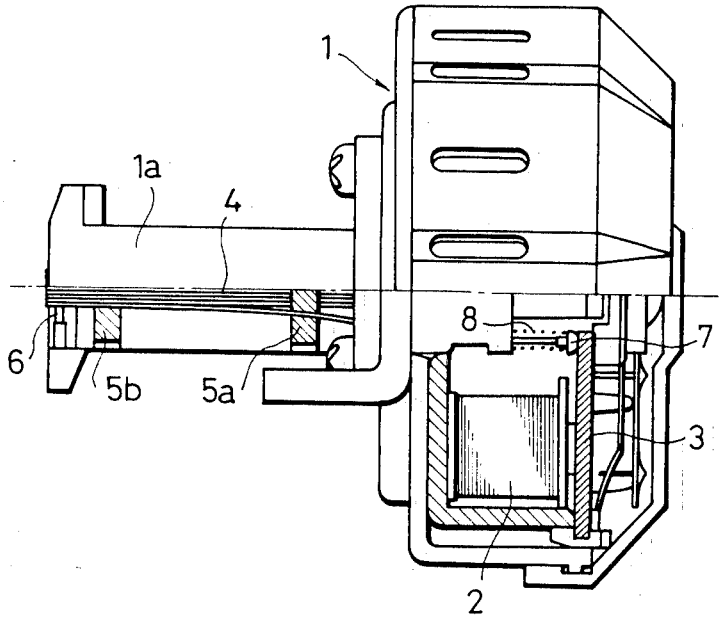
Fig.1 PRIOR ART
FIG. 1 is a profile view with the lower half in section showing a conventional wire-dot type printing head.

A preferred embodiment of the present invention will now be described in detail with reference to FIGS. 2 and 3.

The embodiment includes a main case 10*a*, a forward case 10*b* and a rear case 10*c*. A yoke 11 is positioned between the main case 10*a* and the rear case 10*c*, and a securing member 12 is provided to secure the entire members 10*a*, 10*b*, 10*c*, and 11 together in a resilient manner. The cases 10*a*, 10*b*, 10*c*, are made of a plastic resin material, while the yoke 11 is made of a magnetic material. As best illustrated in FIG. 3, the main case 10*a* includes a flange having a polygonal shape formed at its forward part and a cylindrical guide portion 10*d* formed at the center. A plurality of radially disposed guide holes 10*e* are provided through the guide portion 10*d*. The forward case 10*b* has a forward surface also formed into a polygonal shape and a central portion provided with a plurality of guide holes 10*f* arranged in two rows, the holes 10*f* being separated from each other by a minute spacing and having a diameter smaller than the diameter of the holes 10*e*. On the rear-side surface (upper surface) of an edge portion of the forward case 10*b*, a pair of projections 10*g* are provided to project rearwardly. The projections 10*g* pass through the holes 14*a* of a planar spring 14 toward the main case 10*a* to be engaged within corresponding openings therewithin for arranging the two cases 10*a* and 10*b* in a correct positional relationship.

The yoke 11 is placed around the guide portion 10*d* of the main case 10*a* and has an outer surface formed into a polygonal shape similar to that of the flange portion of the main case 10*a*. The rear case 10*c* is formed into a cover-like configuration slightly larger than the yoke 11, so that the downwardly projection edge of the rear case 10*c* fits over the rear end of the yoke 11. Coils 13 are wound around the yoke cores 11*a* for providing a plurality of electromagnets. Between the yoke 11 and the rear case 10*c* are provided a plurality of armatures 15, each supported at its radially outer end, so that the armatures 15 are adapted to pivot around these ends under the attracting forces of the electromagnets. More specifically, the armatures 15 are arranged in a circular manner at positions corresponding to those of the electromagnets, and the stem portions of the armatures 15 are placed on the rear edge of the yoke 11. A resilient member 16 having a generally ring shape is provided between the stem portions of the armatures 15 and rear cover 10*c*. The inner portions of the armatures 15 are depressed by the resilient member 16 toward the rear edge of the yoke 11.

A plurality of depressing members 17 are provided in the main case 10*a*. The depressing members 17 are made of a plastic resin material, and each of the members has a main body 17*a* formed with a projecting portion 17*b* at the lower end of one side thereof, and a surface 17*c* to be depressed on the upper end thereof. The main body 17*a* of each depressed member 17 is inserted into a respective hole 10*e* formed through the guide portion 10*d* of the main case 10*a* so that the members 17 are guided to be movable linearly upwardly and downwardly by the holes 10*e*. A generally annular planar spring 14 having a diameter substantially equal to that of the forward case 10*b* has a plurality of resilient arms 14*b* integrally formed at the central part of the planar spring 14 so as to extend radially inwardly. The resilient arms 14*b* each abut against a respective projecting portion 17*b* of the depressing members 17, and urge the depressing members 17 toward the armatures 15. Since the resilient arms 14*b* abut against the projection portions 17*b* of the depressing members 17, the acting lines of the resilient forces exerted by the resilient arms 14*b* to the depressing members 17 pass through the guide holes 10*e* guiding the main bodies 17*a* of the depressing members 17.

Furthermore, wires 18 are extended in parallel with the projecting portions 17*b* of the depressing members 17, and the stem portions of of the wires 18 are inserted into the main bodies 17*a* of the depressing members 17 to be secured thereto in an integral manner. As a consequence, the wires 18 extend linearly in parallel with the operating direction of the depressing members 17. Forward ends of the wires 18 are slidably extended through the guide holes 10*f* of the forward case 10*b* to such an extent that the ends project forwardly beyond the forward end of the case 10*d*. A platen 21 is placed in opposition to the forward case 10*d* as shown in FIG. 2. A recording paper 22 and an inked ribbon 23 are placed between the forward case 10*b* and the platen 21.

The operation of the printing head of this invention will now be described.

Figure 2:
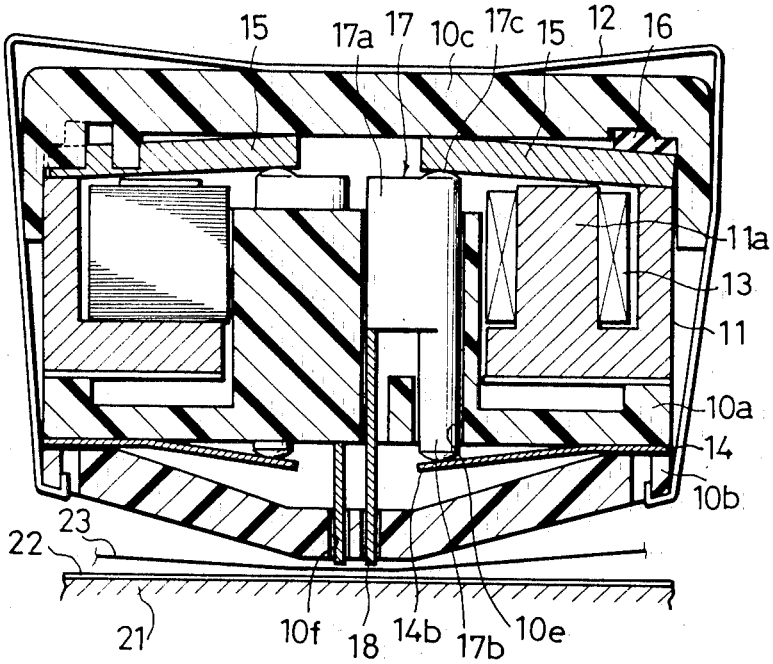
FIG. 2 is a sectional view showing a preferred embodiment of the present invention.
Figure 3:
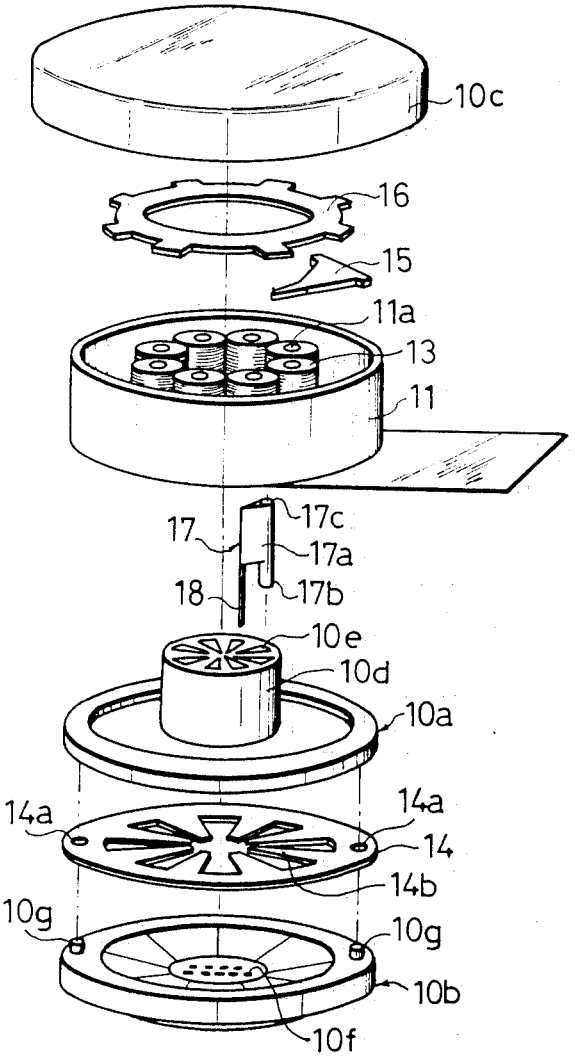
FIG. 3 is an exploded perspective view of the embodiment shown in FIG. 2.

In the state show in FIG. 2, none of the coils 13 are energized, and hence the electromagnets are not operated. Upon energization of selected coils 13, the armatures 15 corresponding to the energized coils 13 are attracted to move the depressing members 17 linearly downwardly. The downward movement of the depressing members 17 cause the wires 18 integrally secured thereto to advance downwardly along linear paths so that the forward ends of the wires 18 project forwardly from the case 10*b*. The projecting wires 18 impact the recording paper 22 through the inked ribbon 23 thereby forming dots corresponding to the area of the tip of the wires 18. When the energization of the coils 13 is interrupted, the depressing members 17 are forced upward together with the armatures 15 by the resilient arms 14*b* of the planar spring 14. At this time, since the acting lines of the resilience forces of the arms 14*b* pass through the guide holes 10*e* receiving the depressing members 17, and furthermore the resilient arms 14*b* urge the depressing members 17 substantially upwardly, the depressing members 17 are retracted slidingly upwardly without being subjected to any oblique force. As a consequence, there is substantially no possibility of a frictional force damaging the internal surfaces of the guide holes 10*e*, and since it is not necessary to excessively strengthen the planar spring 14, the exictation of the electromagnets can be minimized and electric power required can be economized.

The advantageous effects of the present invention are as follows.

(1) Since the movements of the armatures are transmitted to the depressing members, to which the stem portion of the linearly extending wires are secured in an integral manner, the necessity of providing bent passages for the wires as in the conventional printing head shown in FIG. 1 can be eliminated. The elimination of the bent passages reduces the frictional resistance of the wires substantially, and reduces the energy required for operating the printing head.

(2) Since the imprinting wires are extended linearly, the insertion of the wires into the guide members and the like can be faciliated and the assembling of the printing head is simplified.

(3) Since the wires extend linearly, the lengths of the wires can be determined beforehand. Thus the conventional practice of cutting and grinding the wire ends is not required after assembling the printing head, and therefore the labor and cost required for producing the printing head can be substantially reduced.

(4) Since the wires are arranged linearly, the cylindrical portion 1*a* in FIG. 1 is not required for straightening the passage of the wires, and the thickness and the space required for the printing head can be much reduced.

(5) With the wires secured to depressing members in an integral manner, the arranged positions of the wire ends can be varied as desired by varying the size and the shape of the depressing members. For instance, the wire ends can be disposed is a row or otherwise without bending the wires.

(6) Since no oblique forces are applied, the depressing members and the wires can be reciprocated in a linear manner. Furthermore, since frictional forces are minimized between the depressing members, wires and the guide holes, amounts of wear of these members can be minimized, and the operational life thereof can be elongated. Since the sliding resistance of the depressing members is restricted, the spring force of the resilient member and the attracting force of the electromagnet can be reduced.

(7) Since the depressing members are depressed by the armatures at positions further from the center of the cases than the wire securing positions of the depressing members, a sufficient distance can be maintained between the driving portions of the armatures regardless of the minute spacing between the wires. Furthermore, the depressing members and the wires can be spaced from each other by a minute distance and yet reciprocated in linear manner, and therefore no harmful forces are applied to the moving parts of the wires. As a consequence, the driving forces required for the wires can be minimized and the power consumption in the electromagnets can be reduced.

According to the present invention, the linearly movable depressing members to which linear wires are integrally secured are moved by the armatures, while guide holes guiding the depressing members are provided in the case in a manner such that the acting lines of the forces of a resilient member urging the depressing members toward the retract postions pass through the guide holes. As a consequence, no oblique forces are applied to the depressing members and the wires secured thereto, so that the linear movements of the depressing members and smooth reciprocating movements of the wires are assured. Since no useless frictional forces are exterted between the guide holes and depressing members or wires, wear of these members can be minimized and the operational life thereof can be elongated. Furthermore, since the sliding resistances for the depressing members are small, the spring forces required for the resilient member and the attracting forces of the electromagnets can be minimized, and the power consumption of the electromagnets can be economized.

I claim:

1. A printing head for printing on a recording medium by impacts from the ends of linear printing wires comprising a casing defining a plurality of linear passageways arranged around a central axis, respective depressing members axially linearly movable within each of said passageways and having integral therewith centrally extending portions carrying the ends of the respective printing wires for purely linear movement, means including a resilient member for urging said depressing members in a first direction within said casing, and means including a plurality of electromagnets arranged around said passageways and magnetic armatures each contacting an end portion of a respective depressing member for selectively moving said depressing members linearly in a second direction within said passageways for projecting the other ends of selective printing wires out from said casing by linear movement thereof, and wherein the axes of said linear printing wires moved by the depressing members are located nearer to said central axis of said printing head than the axes of said depressing members.

2. A printing head according to claim 1, said depressing members each having a main body portion contacting the respective armature at one end portion thereof and said resilient member at the other end portion thereof along a line extending generally parallel to the respective passageways.

3. A printing head according to claim 1, the portion of said main body portions contacting the respective armatures and said resilient member having a rounded surface.

4. A printing head according to claim 1, said casing includes a forward end portion having holes for guiding the end portions of said wire, and said resilient member being formed by a plate spring held in said forward end portion and having a plurality of arms each urging a respective depressing member inwardly of said casing.

5. A printing head according to claim 1, said casing being formed with a plurality of guide openings each receiving a respective depressing member for guiding its linear movement.

* * * * *